US007044675B2

(12) United States Patent
Nowak et al.

(10) Patent No.: US 7,044,675 B2
(45) Date of Patent: May 16, 2006

(54) LEAK RESISTANT WRITING INSTRUMENT

(75) Inventors: Michael T. Nowak, Cheshire, CT (US); Larry G. Thomas, Spartanburg, SC (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 10/315,659

(22) Filed: Dec. 10, 2002
(Under 37 CFR 1.47)

(65) Prior Publication Data

US 2004/0109721 A1 Jun. 10, 2004

(51) Int. Cl.
*B43K 5/18* (2006.01)
*B43K 23/12* (2006.01)

(52) U.S. Cl. ..... 401/225; 401/227; 401/247

(58) Field of Classification Search ..... 401/196, 401/198, 179, 205, 199, 223, 224, 225, 227, 401/247

See application file for complete search history.

(56) References Cited

U.S. PATENT DOCUMENTS 3,628,876 A * 12/1971 Casey et al. ..... 401/138
4,104,781 A * 8/1978 Midorikawa ..... 264/45.1
5,079,080 A * 1/1992 Schwarz ..... 442/335
5,971,646 A * 10/1999 Chavatte et al. ..... 401/199
6,112,380 A * 9/2000 Dolan et al. ..... 24/715.4
6,322,269 B1 * 11/2001 Witz et al. ..... 401/198
6,413,001 B1 * 7/2002 Kaufmann ..... 401/198

* cited by examiner

*Primary Examiner*—David J. Walczak
(74) *Attorney, Agent, or Firm*—Jones Day

(57) ABSTRACT

A writing instrument containing an ink reservoir, a writing medium, and a writing tip. Advantageously, a superabsorbent polymer can be associated with any writing instrument element or component, in order to absorb a writing medium to an extent sufficient to prevent abnormal or undesired leakage of the writing medium. The SAP can include, but is not limited to, polymers or copolymers preferably present at or near the surface of the writing instrument element or component in an amount such that the SAP does not substantially interfere with the desired communication or flow of the writing medium from the reservoir to the writing tip during normal use. Writing instruments according to the present invention should exhibit increased writing medium leak resistance.

16 Claims, 3 Drawing Sheets

LEAK RESISTANT WRITING INSTRUMENT

FIELD OF THE INVENTION

The present invention relates generally to a writing instrument containing or including at least one component formed from a writing medium-absorbent and/or water-absorbent polymer, particularly a superabsorbent polymer or copolymer. In particular, the writing medium-absorbent polymer can be disposed with respect to the writing instrument to improve leak resistance.

BACKGROUND OF THE INVENTION

One challenge that writing instrument designers have historically faced is to prevent or to inhibit undesired leakage of ink from the writing instrument, while maintaining ease of writing, uniformity of performance, and other beneficial properties of the ink, such as viscosity or flowability, adherence to the writing substrate, etc. There are many ways in which writing instruments, and the inks contained therein, have been altered physically or chemically to reduce the incidence of leakage of the ink from the writing instrument.

As it was theorized that ink leakage could be linked to the relative surface energies of the ink and the interior of the writing instrument with which it is contacted, there has been disclosure in the prior art of the coating of ink-contacting areas or ink reservoirs within a writing instrument with a polymer to minimize leakage and/or to minimize ink interaction with the interior surface.

Occasionally, there can be a pressure difference between the ink reservoir on the inside of the writing instrument and the external ambient atmosphere. Equilibration of the pressure difference can be relieved by ink flowing out of the internal ink reservoir, i.e., ink leakage. In order to prevent or to inhibit ink leakage from the writing instrument under such circumstances, a buffer ink reservoir is disclosed in the prior art into which overflow ink may be stored. The overflow ink can be returned to the internal ink reservoir upon equilibration of the pressure difference.

Superabsorbent polymers and copolymers are well known in the scientific literature for their utility in absorbing water, saline, and a variety of bodily fluids, such as urine (natural or artificial), blood, etc., and particularly for their use in practical applications such as diapers, incontinence pads, feminine hygiene products, and the like. However, the use of absorbent polymers or copolymers in applications involving writing media is scant at best.

Although absorbent polymers and copolymers have been used in absorbing printing inks, the prior art offers no guidance as to the use of superabsorbent polymers or copolymers to absorb other types of inks, such as used in hand-held or finger-manipulable writing instruments.

It would be desirable to design a writing instrument that has reduced leakage of ink within or from its interior. It would be particularly desirable to design and/or to produce a leak resistant writing instrument containing an ink absorbing component located in areas particularly prone to ink leakage.

SUMMARY OF THE INVENTION

One aspect of the present invention relates to a writing instrument having an ink reservoir for containing a writing medium, a writing tip, and a superabsorbent polymer or copolymer (herein "superabsorbent polymer" or "SAP" for the sake of simplicity, without any intent to limit). The SAP may be associated with the writing instrument in any desired manner. For instance, the SAP may be provided at or near the surface of a component of the writing instrument or incorporated into the material of a component of the writing instrument. It is preferred that the superabsorbent polymer is present in an amount sufficient to prevent, control, or inhibit abnormal or undesired seepage, leakage, or overflow of a writing medium to an undesired location such as within the writing instrument or to the exterior of the writing instrument. It is also preferred that the amount of superabsorbent polymer present in or on the writing instrument, or a component or element thereof, is not so much as to trap within the superabsorbent polymer a significant percentage of the writing medium or so much as to substantially interfere with the use, aesthetics, or functionality of the writing instrument, e.g., the desired flow of the writing medium from the ink reservoir to and through the writing tip during use.

The superabsorbent polymer can be placed or located within the writing instrument according to one embodiment of the invention, or incorporated on or within an element of the writing instrument according to another embodiment of the invention, and can preferably function to absorb writing medium which would leak to an undesired area. Preferably, the superabsorbent polymer does not substantially interfere with the desired communication or flow of the writing medium from the reservoir to the writing tip during normal use.

Preferred SAPs for use in the writing instrument according to the invention include, but are not limited to: poly (alkyl acrylate); poly(alkyl alkacrylate); poly(acrylic acid); at least partially neutralized poly(acrylic acid); poly (alkacrylic acid); at least partially neutralized poly (alkacrylic acid); a copolymer containing at least one of the aforementioned components or a repeat unit thereof; and a mixture or blend thereof. Preferred writing instruments according to the invention include, but are not limited to ball point pens, rollerball pens, free ink pens, felt-tip pens, markers, and highlighters.

The amount of superabsorbent polymer present in writing instruments according to the present invention may vary, depending upon a number of factors including, but not limited to: the initial amount of writing medium; the absorbency of the superabsorbent polymer with respect to the writing medium; the absorption efficiency of the superabsorbent polymer with respect to the writing medium; the amount of writing medium leakage anticipated; the location of writing medium leakage and superabsorbent polymer placement; the effect of the superabsorbent polymer on the properties of the writing instrument components on or in which the superabsorbent polymer is applied or contained; etc.; or any combination thereof. Preferably, the ratio of the maximum amount of writing medium contained within the writing instrument to the total amount of SAP in the writing instrument can be at least about 5:1, more preferably at least about 10:1, alternately at least about 20:1. Also preferably, the ratio of the maximum amount of writing medium in the writing instrument to the total amount of SAP in the writing instrument can be less than about 200:1.

In certain cases, because of the nature and/or strength of the molecular interactions between the writing medium and the superabsorbent polymer in certain writing instruments according to the invention, the writing medium may not be substantially reversibly absorbed (i.e., may be substantially irreversibly absorbed) by the superabsorbent polymer, in direct contrast to the writing medium generally being substantially reversibly absorbed by a temporary ink storage element in the writing instrument (such as described herein). Alternately, either when the nature and/or strength of the molecular interactions between the writing medium and the superabsorbent polymer are altered or, more commonly, when temperature and/or pressure are/is applied externally, the writing medium may be reversibly absorbed to a higher degree.

Another aspect of the present invention relates to a method of making a writing instrument and/or a method of improving the leak resistance of a writing instrument. Each of the methods include providing a superabsorbent polymer, as described above, in relation to a writing instrument in an amount sufficient to prevent abnormal or undesired seepage, leakage, or overflow of the writing medium to an undesired area other than through the writing tip during normal use.

DEFINITIONS

Unless otherwise specified, the term "water," as used herein, should be understood to refer to tap water or deionized water, preferably double-deionized (double DI) water (i.e., only double DI water is used for materials property testing).

As used herein, the term "substantially" may refer to more than about 95%, preferably more than about 98%, more preferably more than about 99%, most preferably more than about 99.5%. Therefore, the phrase "substantially not," as used herein, may refer to less than about 5%, preferably less than about 2%, more preferably less than about 1%, most preferably less than about 0.5%. Where applicable, all percentages expressed herein are by weight, unless otherwise specified.

As used herein, the term "alkyl," in reference to a chemical or polymer repeat unit, should be understood by one of ordinary skill in the art to include linear, branched, and/or cyclic hydrocarbon moieties that are attached by a single covalent bond to the remainder of the chemical or polymer repeat unit. In the case of a polymer repeat unit, the alkyl group is a pendent group to the polymer chain. For instance, alkyl groups may fall in the following sequence (shown here from one-carbon through five-carbon moieties): methyl, ethyl, n-propyl, isopropyl, n-butyl, sec-butyl, tert-butyl, isobutyl, n-pentyl, 1-methyl-n-butyl, 2-methyl-n-butyl, 3-methyl-n-butyl, 1,1-dimethyl-n-propyl, 2,2-dimethyl-n-propyl, 1,2-dimethyl-n-propyl, 1-ethyl-n-propyl, 2-ethyl-n-propyl, 1-n-propyl-ethyl, 1-isopropyl-ethyl, 1-methyl-1-ethyl-ethyl, etc. The hydrocarbon moieties may include any number of carbon groups, and, in one embodiment, include less than about 20 carbon atoms.

As used herein, the prefix "alk," when used in reference to a chemical or polymer repeat unit, should be understood by one of ordinary skill in the art to include an alkyl group attached by a single covalent bond to the remainder of the chemical or polymer repeat unit. In the case of a polymer repeat unit, the alkyl group represented by the prefix "alk" is a group attached directly to the polymer chain. The difference between "alkyl" and "alk" can be distinguished as follows. For instance, the repeat unit structures of poly (methyl acrylate), poly(methacrylate), and poly(methyl methacrylate) are shown below. The first structure contains only a methyl group attached to a site already pendent to the polymer backbone ("alkyl" case); the second structure contains only a methyl group attached directly to a site on the polymer backbone, while R represents an unknown chemical moiety ("alk" case); and the third structure contains two methyl groups, one attached to a site already pendent to the polymer backbone and the other attached directly to a site on the polymer backbone (both "alkyl" and "alk" cases).

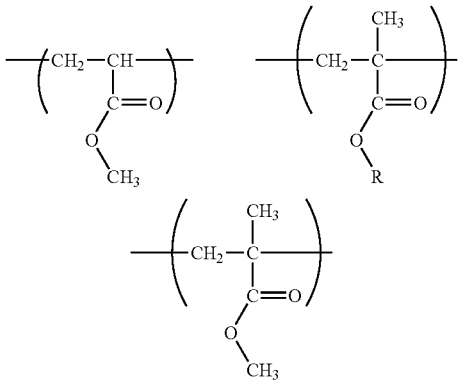

DETAILED DESCRIPTION OF THE PREFERRED EMBODIMENTS

Figure 1A:
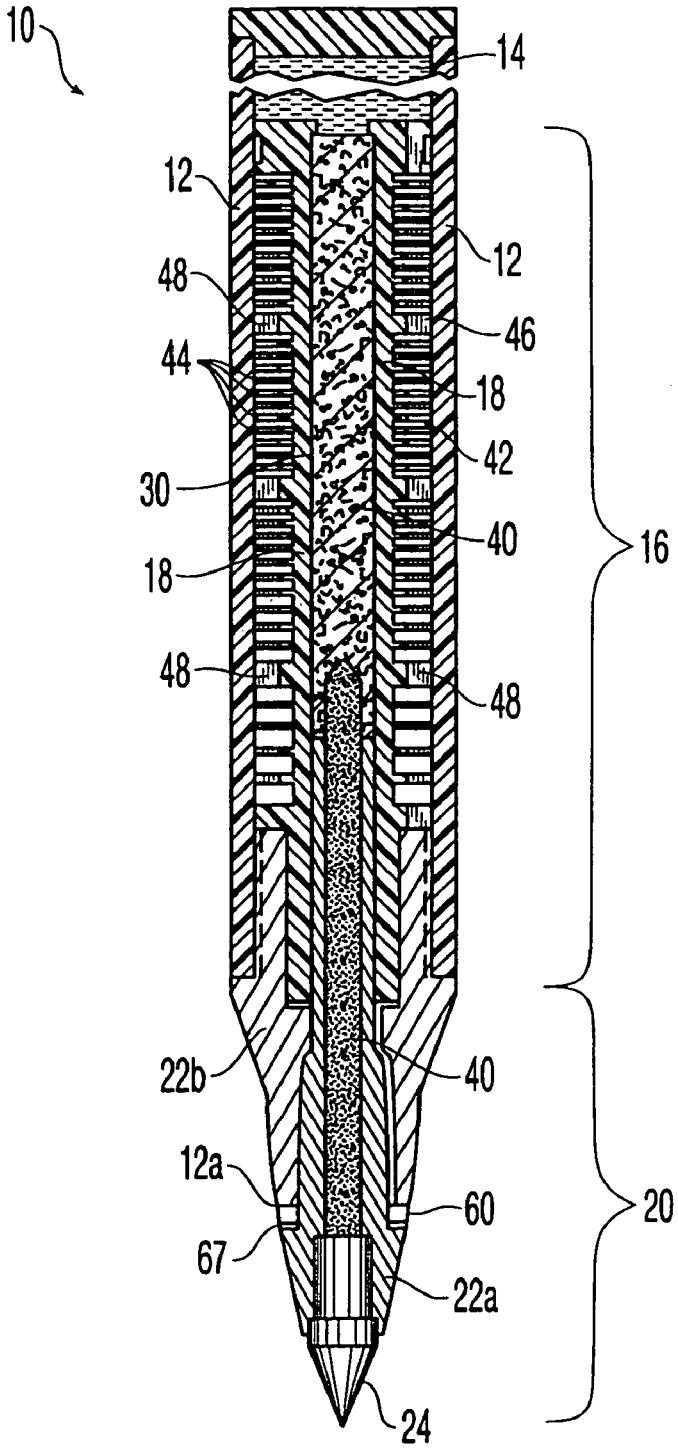
FIG. 1*a* depicts a cross-sectional view of an exemplary writing instrument having a component formed from a superabsorbent polymer in accordance with the principles of the present invention.

Examples of the types of writing or marking ("writing" is used herein for the sake of convenience and without intent to limit) instruments in which the principles of the present invention may be applied include, but are not limited to, ball point pens, rollerball pens, free ink pens, felt-tip pens, markers, highlighters, and the like. In one embodiment, the writing instrument may not include ink-jet and/or offset printers. In another embodiment, the writing instrument is a hand-held writing instrument. In another embodiment, the writing instrument is finger-manipulable.

Most writing instruments include a body (alternately referenced as a barrel) and have a proximal, or non-writing, end and a distal, or writing, end. The writing instrument body or barrel generally has a hollow central portion, which is usually, but is not limited to being, substantially cylindrical, prismatic, or frusto-conical in shape. In some writing instruments, the hollow central portion is open only at the writing (or distal) end, and the proximal end is closed by an end plug integral with the barrel. Alternatively, the hollow central portion can be open at both the proximal and distal ends. An end plug can be slidingly, rotationally, or in some other way mechanically mated with the opening at the proximal end of the barrel in order to seal and/or to protect the interior of the barrel and/or the elements therein.

Writing instruments also generally contain a writing tip from which a writing medium (herein "ink" for the sake of convenience and with no intent to limit) can emanate during use. In some writing instruments, the writing tip may be in the form of a point (e.g., roller ball or ball point) through which a writing medium may flow to be applied onto a writing substrate (e.g., during normal use), and to which an ink transfer member communicates writing medium from a reservoir. Alternatively, in other writing instruments such as highlighters, markers, felt-tip writing instruments, and certain free-ink writing instruments, the writing tip may include a nib, which may be a porous or fibrous component that extends through an axial bore in a nib support and partially to the exterior of the writing instrument at its distal end.

An ink transfer member, which includes a component or assembly of components, may be provided to transfer the writing medium from the writing medium reservoir to, and sometimes through, the writing tip for application of the writing medium onto a writing substrate (i.e., normal use). The ink transfer member may include an ink feeder, which comprises a fibrous or porous material that carries writing medium from its proximal end (extending into the reservoir) to its distal end (ultimately to the writing tip), and, optionally, a wick extending from the distal end of the ink feeder to the writing tip. If a nib is provided, it may be a separate element from the ink transfer member, or may be integral with the ink transfer member, functioning as the distal end of the ink transfer member, the proximal end of which can extend to the ink reservoir.

The writing medium may be held directly in the barrel in a free state or in a writing medium retaining material, such as a fibrous wad. In such case, the body directly holds the writing medium. Alternatively, the writing medium may be held in a cartridge (e.g., in an ink tube for ballpoint ink, or in a reservoir for free-ink), and a barrel may be inserted over or may receive the cartridge.

Typically, a front nose cone, and optionally a point support, is provided at the front end of a writing instrument to hold or support the writing tip. The front nose cone is generally frusto-conical but may be given any appropriate shape. Typically, the proximal end of the front nose cone can be slidingly, rotationally, or in some other way mechanically mated with the opening at the distal end of the barrel. Typically, the distal end of the front nose cone can be shaped to hold the point (or point support, if provided). If the writing instrument includes a retractable writing tip, the point (and/or point support, if provided) may extend through the open distal end of the front nose cone. In most highlighters, markers, and felt-tip writing instruments, as well as certain free-ink writing instruments, especially where a nib is provided, a single nib support element may be present with the combined characteristics of the front nose cone and point support elements detailed above.

Free-ink writing instruments generally include a reservoir in which writing medium of a particular viscosity is contained in a "free state," as opposed to writing instruments in which a writing medium is held within a porous or fibrous material that serves as the writing medium reservoir. A free-ink writing instrument may include a temporary ink storage area into which the writing medium may overflow, especially in response to a pressure and/or temperature difference between the interior of the ink reservoir and the ambient atmosphere outside the writing instrument. The ink storage area in certain writing instruments may contain an ink storage element, e.g., a sponge, a porous foam, or a baffle (described in further detail below), capable of reversibly channeling writing medium overflow to and from the ink transfer member, as needed with relative fluctuations in temperature and/or pressure differences between the ink reservoir and the ambient atmosphere on the exterior of the writing instrument.

For example, a baffle can be configured to store abnormally high writing medium flow resulting from increased air pressure in the ink reservoir caused, for example, by changes in ambient temperature or by pressure or temperature increases upon extended gripping of the barrel. An exemplary baffle can have an axial bore or hollow cavity, through which the ink transfer member extends, and a plurality of spaced apart annular elements or fins with annular spaces formed therebetween for temporary storage of writing medium. For example, an exemplary baffle is described in U.S. Pat. No. 5,906,446 to McCullough et al., the disclosure of which patent, in its entirety, is hereby incorporated by express reference hereto. In most baffles, a narrow slit running longitudinally through the fins defines an ink groove which communicates writing medium from the reservoir to the annular spaces and also communicates the annular spaces with one another under high reservoir pressure conditions. As pressure in the reservoir decreases, writing medium which has been temporarily stored in the baffle may be returned to the ink reservoir via the ink groove. In addition, there is often another groove, wider than the ink groove, formed longitudinally through the fins to define an air groove. Air can enter the air groove through a vent typically in the vicinity of the writing tip and can reach the ink reservoir by traveling through the air groove as writing medium is expended, thereby avoiding the creation of a vacuum upon loss of writing medium volume. Often, the air groove and the ink groove are directly opposite each other, i.e., at about 180° from each other, across the fins. However, other relative locations are possible.

Writing instruments may also include a writing instrument cap, which, if provided, can usually be removably disposed over at least the writing tip of the writing instrument. Writing instrument caps generally possess an interior surface and an exterior surface, such that the interior surface covers the writing tip (and optionally some portion of the external surface) of the writing instrument when the writing instrument is not in use. There are many means by which a cap may be removably disposed (e.g., slidably, rotatably, retractably, interlockingly, or the like) over at least the writing end of the writing instrument according to the invention.

In accordance with the principles of the present invention, a superabsorbent polymer is associated or provided with respect to the writing instrument to enhance leak resistance (i.e., to reduce ink leaking, seepage, or overflow to undesirable areas). Preferably, the SAP is applied or formed to prevent abnormal or undesired seepage, leaking, or overflow (herein "leakage" for the sake of simplicity and without any intent to limit) of a writing medium at or to an undesired area, such as an undesired portion of the writing instrument or to the exterior of the writing instrument. The SAP may be applied to or may be used to form at least one component of a writing instrument or may be otherwise associated or provided with respect to the writing instrument, as described in greater detail below.

The SAP may be advantageously present in an amount sufficient to prevent, control, or inhibit (herein "prevent" for the sake of simplicity and without any intent to limit) leakage of a writing medium. The amount of SAP present in or on the writing instrument, or a component or element thereof, can advantageously be enough to prevent leakage of the writing medium but preferably not so much as to trap a significant percentage of the writing medium or so much as to interfere significantly with the desired flow of the writing medium from the ink reservoir to and through the writing tip during use. It is thus desirable for the SAP to be present in a relatively small amount, as compared to the maximum amount of writing medium present in the writing instrument according to the invention. Certain other specific properties of SAP's in writing instruments according to the invention are described in further detail below.

Although superabsorbent polymers may be used to prevent leakage of a writing medium of any viscosity, SAP's are particularly useful in writing instruments that contain relatively low viscosity writing media. For instance, a writing instrument containing a writing medium having a relatively low viscosity (e.g., below about 100 cps) obtains a particular benefit from the presence of a superabsorbent polymer, in accordance with the principles of the present invention. In one embodiment, the viscosity of the writing medium is from about 2 cps to about 80 cps. In prior art writing instruments containing relatively low viscosity writing media, each element of the writing instrument generally had to be fabricated very precisely, requiring tight tolerance control on each element, or portions thereof, in order to prevent leakage of the writing medium. The use of a superabsorbent polymer in a writing instrument permits the requirements for tight tolerance control to be relaxed, at least to some extent, while establishing, maintaining, or improving (herein "maintaining" for the sake of simplicity and without any intent to limit) the leak resistance of the writing instrument (e.g., the ability of leakage in a writing instrument to be substantially prevented).

The SAP may advantageously be placed or located within the writing instrument according to another embodiment the invention on its own or formed as a unitary instrument component (e.g., the SAP may be compounded into at least one of the components of the writing instrument such that the component(s) of the writing instrument may be formed from SAP or a mixture or blend of SAP with another material). Additionally or alternatively, the SAP may be provided on or within an element of the writing instrument according to the invention (e.g., SAP or a mixture or blend of SAP with another material may be applied to the surface of a component). In either case, the SAP can advantageously function to absorb excess writing medium such that the SAP does not substantially interfere with or disrupt the desired communication or flow of writing medium from the reservoir to the writing tip during normal use. The SAP may advantageously be provided at any location or contained or included in or on any element upon or within the writing instrument to satisfy this function. For instance, the SAP may be at or near the surface of a component of the writing instrument. The form of the SAP and/or the particular element or location in or on which the SAP is included or contained in the writing instrument, as well as other parameters of the SAP, will generally depend upon the design of the writing instrument. In a preferred embodiment, the SAP is provided in a manner such that it is substantially not dissolved by the writing medium.

Exemplary ways in which the SAP may be present on or within (or otherwise associated with) a writing instrument include, but are not limited to: a coating on a portion of the surface of a writing instrument component or element; as a pre-fabricated, shaped component or element (e.g., as a relatively solid material, i.e., having a density of at least about 0.60 g/cc, or as a foam material, i.e., having a density of less than about 0.60 g/cc) disposed in contact with, or immediately adjacent to, and optionally adhered to, a writing instrument component or element, or forming a part of a typical writing instrument (such as forming a front nose cone, an end plug, or the like); a mass of packed particles, packed powder, packed granules, or gelatinous SAP material disposed in contact with, or immediately adjacent to, and optionally adhered to, a writing instrument component or element; or some combination thereof.

The area of the writing instrument in which the SAP is provided typically is selected based on the need for an SAP at such location (i.e., typically in an area prone to leakage). Although there may be many places or locations in a writing instrument where writing medium leakage may take place, particularly undesirable are those areas of the writing instrument that are exposed to, or contactable by, a user of the writing instrument and/or that are exterior to the writing instrument (e.g., that are part of the ambient environment), other than the writing tip, during normal use. For example, one potential location for leakage is between the writing or distal end of the writing instrument and the front nose cone or point support elements, e.g., proximate to an air hole, as described below in Example 1. However, writing medium may also exhibit leakage via the normal flow pathway from the ink reservoir to the writing tip while the writing instrument is not in use. Additionally, any places or locations in a writing instrument where elements or components are assembled or fit together can be potential or exemplary locations at which writing medium leakage occurs. Writing instruments according to the present invention thus should exhibit improved leak resistance.

In one embodiment, the SAP may be placed or located at or near the surface of any element or component of the writing instrument such that the SAP does not substantially interfere with the desired communication or flow of the writing medium from the reservoir to the writing tip during normal use. Additionally or alternatively, a sufficient amount of the SAP may be present within at least about 10 microns, preferably within at least about 1 micron, of the surface of the writing instrument element or component with which the SAP is associated.

In a writing instrument in which an end plug is mated to a proximal opening in the barrel, a writing instrument according to the invention may contain SAP in proximity to the mating junction between the end plug and the proximal opening in the barrel, and in an amount and in a location sufficient to prevent leakage of writing medium to the exterior of the writing instrument through or around the end plug. The location of the SAP in this embodiment may advantageously include, for example, within the material from which the end plug itself is formed, optionally as a mixture or blend with another polymer, or as an at least partial coating on the surface of the end plug, with a sufficient amount of the SAP being present at or near the surface of the portion of the end plug that contacts the interior of the barrel or is exposed to the interior of the barrel such that the SAP or polymer blend may absorb writing medium leakage on and/or around the surface of the end plug.

Additionally or alternatively, the SAP may be present within the ink storage area, but preferably not on or within the ink storage element. For example, the SAP may be present in the ink storage area in an amount sufficient to prevent leakage of the writing medium such as to an undesirable portion of the writing instrument or to the exterior of the writing instrument. For example, SAP may advantageously be provided within the boundaries defining the ink storage area itself (whether that be the interior surface of the barrel or of the wall material of the ink tube or ink storage area disposed within the interior surface of the barrel), or portions thereof, with a sufficient amount of the SAP being present at or near the surface of the ink storage area boundary, such that the SAP may absorb writing medium leakage from the ink storage element.

Figure 2:
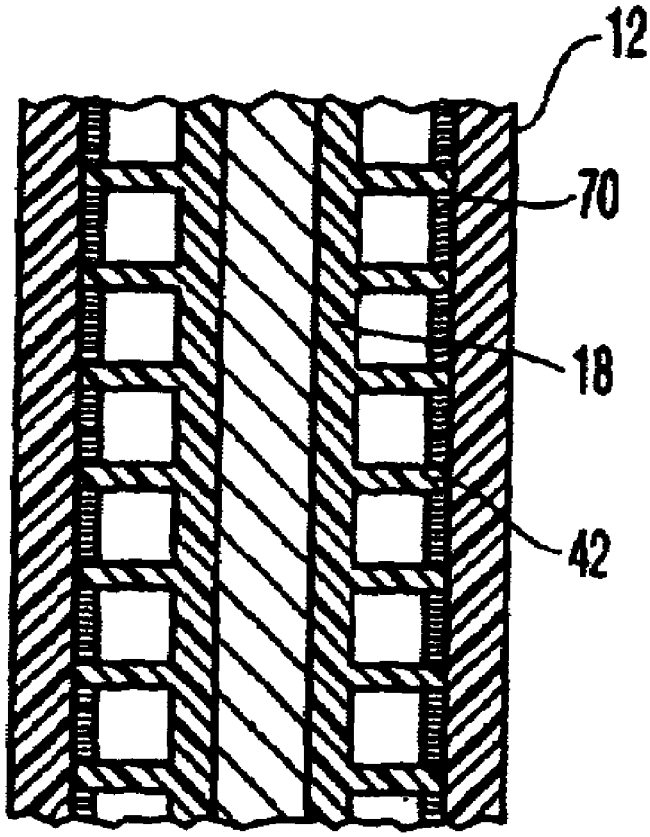
FIG. 2 depicts an exemplary embodiment of the present invention where an SAP is located in within the annular spaces of the temporary ink storage member.

In an embodiment in which an ink storage element in the form of a baffle is provided, the SAP may be provided in conjunction with the baffle. For instance, the SAP may be present on or within an axial bore through the baffle. However, as the SAP should not substantially interfere with the communication of writing medium between the components of the writing instrument in the desired pathway, it is preferred that any SAP located in the ink storage area and/or proximate to the ink storage element not contact the ink transfer member, so as not to draw writing medium therefrom. FIG. 2 shows an exemplary embodiment of the invention, where an SAP 70 is located between fins 42 in temporary ink storage member 18. The SAP 70 may be adhered to the interior surface of the barrel 12 as well.

Additionally or alternatively, the SAP may optionally be provided at or near the writing tip, either on the exterior or the interior of the writing instrument, preferably the latter. For example, the SAP may be present on the interior of the writing tip in an amount sufficient to prevent leakage of the writing medium such as to an undesirable portion of the writing instrument or to the exterior of the writing instrument. Advantageously, the presence of the SAP may prevent bleeding or blobs of writing medium (depending on the writing medium viscosity) from occurring, thus maintaining a clean application of writing medium to the writing or marking surface. In an embodiment where the writing tip includes a rollerball or a ball point, the SAP may be associated with the point support and/or the front nose cone. In an embodiment where the writing tip includes a nib, the SAP may be associated with the nib support.

Figure 3:
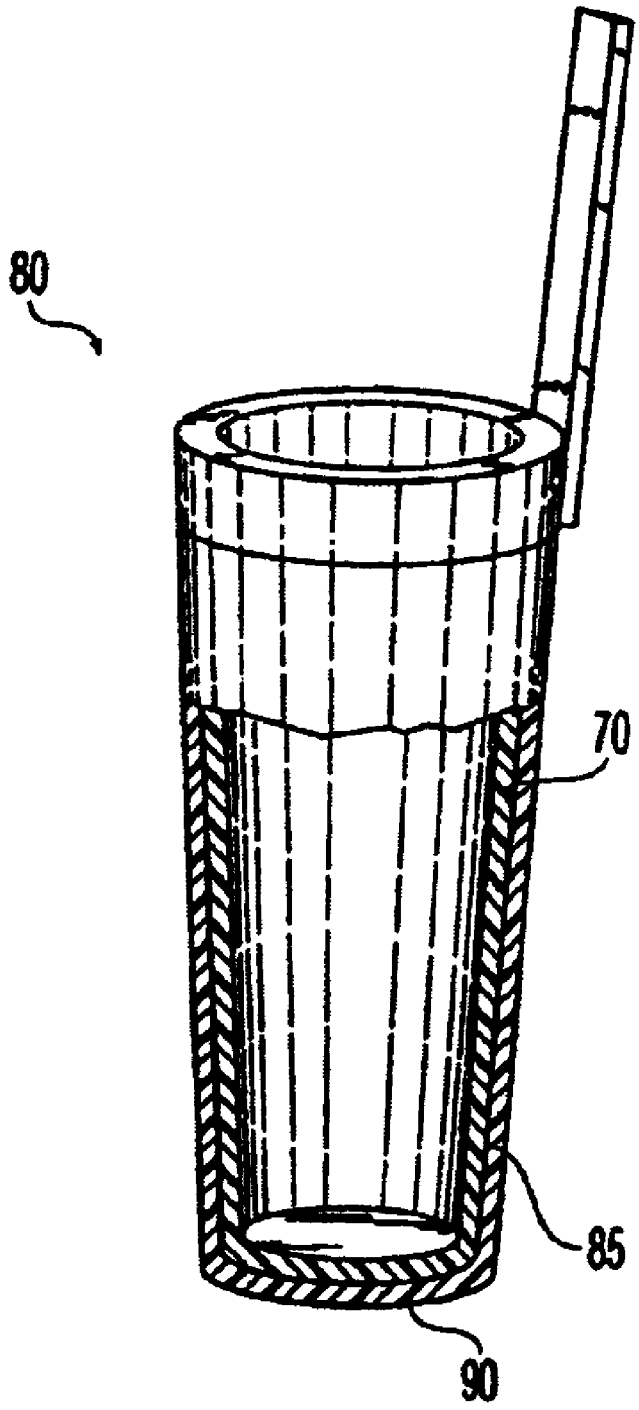
FIG. 3 depicts a cross-sectional view of an exemplary embodiment of the invention where a superabsorbent material is associated with the interior surface of a writing instrument cap.

Additionally or alternatively, the SAP may optionally be provided on a portion of a cap, such as an interior portion of a cap. For example, as illustrated in the cross-sectional view of FIG. 3. SAP 70 may be associated with interior surface 85 of a writing instrument cap 80 having an interior surface 85 and an exterior surface 90. The cap of FIG. 3 can be removably disposed over writing tip 24 of writing instrument 10 depicted in FIG. 1. In an embodiment where the writing instrument includes a cap, the writing medium, which, for one reason or another, may exhibit leakage from the writing tip and onto the interior surface of the cap when the writing instrument is not in use, may be absorbed by a SAP disposed on the interior surface of the cap. However, the SAP should not, and preferably does not, induce leakage of the writing medium out from the writing tip to contact the SAP such that the SAP causes writing medium leakage. Advantageously, in this embodiment, the SAP will be present in an amount sufficient to prevent leakage of the writing medium from the interior surface of the cap.

The SAP in the writing instrument according to the invention can include any polymer having sufficient absorbency to prevent leakage of writing medium, such as from a desired portion of the writing instrument to an undesired portion within the writing instrument or to the exterior of the writing instrument. Preferably, the absorbency of the SAP in the writing instrument to prevent leakage of the writing medium should be such that the SAP does not substantially interfere with the use, aesthetics, or functionality of the writing instrument.

In one preferred embodiment, the SAP in the writing instrument may advantageously have an absorption capacity of at least about 50 grams of water per gram of polymer, preferably at least about 100 grams of water per gram of polymer. The absorption capacity of the SAP for water is generally measured with the polymer in a powdered or particulate state, regardless of the state in which the SAP is present in the writing instrument. The absorption capacity can be measured, e.g., according to method JIS K 7223 (1996) of the American National Standards Institute. In another preferred embodiment, the SAP in the writing instrument may advantageously have an absorption capacity of at least about 10 grams of ink per gram of polymer, preferably at least about 20 grams of ink per gram of polymer. The absorption capacity of the SAP for ink can be measured with the polymer in a powdered or particulate state, regardless of the state in which the SAP is present in the writing instrument. In order to standardize the test results, the absorption capacity for ink can be measured, e.g., by a method according to method JIS K 7223 (1996) of the American National Standards Institute, except that ink is used instead of water. In one embodiment, the rnk used for the absorption capacity test has the composition of the ink actually present in the writing instrument containing the SAP.

In another embodiment, the ink used for the absorption capacity test can have one of the following compositions, regardless of the composition or type of ink actually present in the writing instrument containing the SAP, according to the invention:

| | Green Ink Value | Black Ink Value | Red Ink Value | Blue Ink Value |
|---|---|---|---|---|
| Component | | | | |
| Demineralized water | 43.4 | 39.5 | 44.8 | 43.5 |
| Ethylene glycol | 35 | 35 | 34.9 | 39.9 |
| NINATE ® 411 | 0.01 | 0.01 | 0.01 | 0.01 |
| Triethanolamine | 0.2 | 0.4 | 0.05 | 0.15 |
| NIPAGIN ® M | 0.04 | 0.04 | 0.04 | 0.04 |
| NIPAGIN ® A | 0.06 | 0.06 | 0.06 | 0.06 |
| COBRATEC ® 99 | 1 | 1 | 1 | 0.1 |
| MILLIKEN BLUE ® 204-3 | 19 | | | 15 |
| TARTRAZINE ® (cone. ex. 165%) | 1.3 | | | |
| BASACID BLACK ® NBX34 | | 24 | | |
| MILLIKEN ACCESS RED ® 7973 | | | 19.1 | |
| KEYACID RED ® XB400 | | | | 1.25 |
| Property | | | | |
| Viscosity (cps) | 3.7–4.3 | 3.7–4.3 | 3.7–4.3 | 3.1–3.7 |
| Specific gravity (at ~20° C.) | 1.064–1.067 | 1.0815–1.084 | 1.0796–1.0826 | 1.064–1.067 |
| Surf. tens. (dyn/cm at ~20° C.) | 40–46 | 40–46 | 39–45 | 40–46 |
| pH (at ~20° C.) | 6.7–7.7 | 7.15–8.15 | 6.6–7.6 | 6.8–7.8 |

Because of the absorbency of the SAP with respect to writing medium in the writing instrument, the ratio of the maximum amount of writing medium contained within the writing instrument to the total amount of SAP in the writing instrument can advantageously be at least about 5:1, preferably at least about 10:1, alternately at least about 20:1. In an alternate embodiment, the ratio of the maximum amount of writing medium in the writing instrument to the total amount of SAP in the writing instrument can be less than about 200:1.

Alternately, either when the nature and/or strength of the molecular interactions between the writing medium and the SAP are altered or, more commonly, when temperature and/or pressure is/are applied externally, the writing medium may be reversibly absorbed to a higher degree. In one such alternate embodiment, at least about 50% of the writing medium that becomes absorbed by the SAP is released into a desirable portion of the writing instrument, i.e., such that the writing medium is released into the desired flow path from the ink reservoir to the writing tip. In another such alternate embodiment, substantially all of the writing medium that becomes absorbed by the SAP is released. In yet another such alternate embodiment, at least about 50% of the writing medium that becomes absorbed by the SAP can be released into a desirable portion of the writing instrument, i.e., such that the writing medium is released into the desired flow path from the ink reservoir to the writing tip, without external application of temperature and/or pressure.

External applications of temperature and/or pressure may include those that are natural or man-made. For example, natural external applications of temperature and/or pressure could arise from significant changes in ambient conditions, such as relative humidity, altitude or depth, latitude and/or longitude, or the like. Man-made external applications of temperature and/or pressure could arise from, for example, manual heating of or applications of pressure to the writing instrument, or a portion thereof.

Examples of SAPs that can be used in the writing instrument according to the invention include, but are not limited to: various natural or chemically modified starch or cellulosic polymers; poly(acrylamide); poly(alkacrylamide); poly(acrylate); poly(alkyl acrylate); poly(alkyl alkacrylate); poly(hydroxy-functionalized alkacrylate), e.g., poly(hydroxyethyl methacrylate), also called polyHEMA; poly (acrylic acid); at least partially neutralized poly(acrylic acid); at least partially saponified poly(acrylic acid); poly (alkacrylic acid); at least partially neutralized poly (alkacrylic acid); at least partially saponified poly(alkacrylic acid); poly(vinyl alcohol); poly(acrylonitrile); poly(alkacrylonitrile); poly(vinyl acetate); poly(alkylene oxide), e.g., poly(ethylene oxide), also called PEO; a polymer containing maleic anhydride repeat units; a copolymer containing at least one of the aforementioned components or a repeat unit thereof; and a mixture or blend thereof, and various chemically modified starch and cellulosic polymers. In one embodiment, the SAP does not contain peptides or polypeptides.

Examples of types of copolymers include, but are not limited to, graft, random, alternating, block, multiblock, star, comb, or dendritic. When both "alkyl" and "alk" groups are present in the SAPs according to the invention, the "alkyl" and "alk" groups may be the same or different. Additionally or alternatively, the SAPs according to the invention may also optionally be exposed to some form of energy, a multiply reactive chemical compound, a multivalent ion, or the like, or a combination thereof, for a sufficient period of time, and/or exposed to conditions sufficient to at least partially crosslink the superabsorbent polymer or copolymer.

One skilled in the art will appreciate that starch may be present in its natural form (e.g., as extracted from one or more plants, or as purified by any method), in a destructured form, or in any number of chemically modified derivative forms, e.g., alkyoxylated derivatives, esterified derivatives, ionically modified starches, oxidized starches, grafted starches, crosslinked starches, or the like, or mixtures thereof.

One skilled in the art will also appreciate that the cellulosic polymer can include, but is not limited to, native or synthetic cellulose, cotton, regenerated cellulose (e.g., rayon, cellophane, or the like), cellulose acrylate, acrylated cellulose, cellulose acetate, cellulose propionate, cellulose butyrate, cellulose acetate-propionate, cellulose acetate-butyrate, cellulose propionate-butyrate, cellulose nitrate, methyl cellulose, ethyl cellulose, carboxymethyl cellulose, carboxyethyl cellulose, cellulose salts, and combinations or copolymers thereof. The cellulosic polymer according to the invention may be present as naturally extracted, as synthesized, or as modified or processed in some way, e.g., partially or fully esterified, partially or fully nitrated, partially or fully regenerated, partially or fully etherified, partially or fully acrylated, partially or fully acidified, partially or fully acid-neutralized, or the like, or combinations thereof.

In certain cases, because of the nature and/or strength of the molecular interactions (e.g., ionic or strong hydrogen-bonding, or the like) between the writing medium and the SAP in certain writing instruments according to the invention, the writing medium may not be substantially reversibly absorbed, i.e., may be substantially irreversibly absorbed, by the SAP, in direct contrast to the writing medium generally being substantially reversibly absorbed by the ink storage element. In one embodiment, no more than about 10% of the writing medium that becomes absorbed by the SAP can be released at ambient conditions, without external application of temperature and/or pressure. In another embodiment, substantially no writing medium that becomes absorbed by the SAP can be released at ambient conditions, without external application of temperature and/or pressure.

Another aspect of the present invention relates to a method for making a writing instrument or for improving the leak resistance of a writing instrument. An SAP as described above is provided upon or near at least a portion of the interior surface of the writing instrument. Alternatively, at least one component of the writing instrument is formed from a material containing SAP. Advantageously, the SAP is provided in a location and in an amount sufficient to prevent leakage of the writing medium to an undesired portion of the writing instrument, or to the exterior of the writing instrument other than through the writing tip during normal use.

In one embodiment, the SAP can be provided (as mentioned above, in the form of any number of different manners) in an area of the writing instrument according to the invention, or on or near the surface of a component, or portion thereof, which is susceptible to leakage of ink to an undesired portion of the writing instrument or to the exterior of the writing instrument. When the SAP is introduced into the writing instrument as one or more pre-fabricated, shaped components, such shaped component(s) may be formed by any appropriate means. Exemplary means of fabrication for the pre-fabricated, shaped component(s) include, but are not limited to, molding, compression molding, blow molding, rotational molding, injection molding, reaction injection molding (RIM), extrusion, sintering, casting, evaporative casting (e.g., from solution, latex, emulsion, or the like), or the like, or combinations thereof. Alternately, in one embodiment, the SAP can be provided in a form other than a foam and obtained from a reactive or non-reactive solution, latex, emulsion, slurry, or the like. Alternately, in another embodiment, the SAP may be provided in a form other than a fiber, weave, mat, anisotropic fibrous network, or the like.

EXAMPLE

An exemplary embodiment of the present invention will be illustrated by reference to the following examples, which is included to exemplify, but not to limit, the scope of the present invention.

Example 1

Hand-Held Free-ink Writing Instrument According to the Invention Containing a Molded Collar Made from SAP and Disposed Proximate to the Air Vent Hole A hand-held free-ink writing instrument 10 was fabricated as shown in FIG. 1 a having a barrel 12 containing an ink reservoir 14 and a temporary ink storage area 16 including a baffle 18, and a writing end 20 including a point support 22*a*, a front nose cone 22*b*, and a point 24. An air vent hole 67 is provided between the distal or writing end 12*a* of the front nose cone 22*b* and point support 22*a*. Writing instrument 10 also contains an ink transfer member 40 extending from ink reservoir 14 to point 24. Baffle 18 includes fins 42 and annular spaces 44 therebetween. Ink groove 46 and air groove 48 are formed longitudinally through fins 42, and axial bore 30 extends substantially axially through baffle 18. For instance, a writing instrument set forth in U.S. Pat. No. 5,906,446 to McCullough et al., the entire disclosure of which is hereby incorporated by express reference hereto, may be used.

Figure 1B:
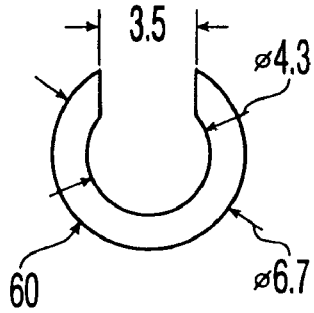
FIG. 1*b* depicts a plan view of an exemplary collar formed from an SAP in accordance with the principles of the present invention.

In addition thereto, a collar 60 of NORSOCRYL D-60 SAP was fabricated (by Emerging Technologies, Inc., of Greensboro, N.C.) in the shape of an annular disc having its central circular portion removed as shown in FIG. 1*b*. The annular disc is flat, having a thickness of approximately 5.3 cm, an inner diameter (of the removed circular portion) of approximately 4.3 cm, and an outer diameter of approximately 6.7 cm. The annular disc also has a 3.5 cm wide portion of its annular ring removed, so that it has a circular horseshoe shape. The collar 60 was placed between distal end 12*a* of the front nose cone 22*b* (i.e., the end of front nose cone 22*b* adjacent writing end 20) and frusto-conical point support 22*a*, so as to be directly proximate to air vent hole 67.

Alternative SAPs, other than those sold under the tradename NORSOCRYL, that may be used in writing instruments according to the invention include, for example, but are in no way limited to, those commercially available from Emerging Technologies, Inc., of Greensboro, N.C., under the tradenames LIQUIBLOCK, SEASORB, and AP; those commercially available from Toagosei Co., of Tokyo, Japan; under the tradename ARONZAP; and the like, as well as a combination thereof.

The writing instrument according to the invention was then subjected to a standard shaker test and compared to similarly constructed free-ink pens without a collar of SAP (Comparative Examples 1–4 below). The standard shaker test involves anchoring the writing instruments to a Red Devil Model No. 5300 Speed Demon Paint Shaker, commercially available from the Red Devil Company of Brooklyn Park, Minn., at room temperature and ambient pressure for a first time period of approximately 1 hour followed by approximately 1 hour of rest (no shaking), followed again by a second approximately 1 hour period of shaking at the same conditions as for the first hour of shaking.

As can be seen by Table 1 below, each of the writing instruments without SAP (i.e., Comparative Examples 1–4) showed considerable leakage in approximately 10% to 40% of the samples, whereas the writing instrument containing SAP according to the invention (i.e., Example 1) showed no observable leakage. In addition, it was noted that the presence of the NORSOCRYL did not adversely affect the writing performance of the writing instrument of Example 1.

TABLE 1

| Identification | SAP | Ink Transfer Member | # of W.I.s showing considerable leakage |
|---|---|---|---|
| Comparative Example 1 | none | PF-15R wick + PI-05 feeder | 2 of 10 |
| Comparative Example 2 | none | PF-15R wick + PI-05 feeder | 4 of 10 |
| Comparative Example 3 | none | PF-15R wick + PCC-01 feeder | 2 of 10 |
| Comparative Example 4 | none | PF-15R wick + PCC-01 feeder | 1 of 10 |
| Example 1 | NORSOCRYL D-60 | PF-15R wick + PA-RX 103 feeder | 0 of 10 |

PF-15R and PA-RX 103 are both polyester fiber non-woven polymers, commercially available from Aubex Corp., of Tokyo, Japan. PI-05 and PCC-01 are both also polyester fiber non-woven polymers, commercially available from Teibow Hanbei Co. of Tokyo, Japan. These wicks and feeders vary from each other by shape, surface tension, and internal/external geometries. It is noted that the PA-RX 103 feeder behaved similarly to the PF-15R and PCC-01 feeders when used in writing instruments not containing SAP.

Although the present invention is described with reference to certain preferred embodiments and drawings, it is apparent that modification and variations thereof may be made by those skilled in the art without departing from the spirit and scope of this invention as defined by the appended claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A writing instrument, comprising:

a writing medium reservoir;

a writing tip; and a superabsorbent polymer associated with a component of said writing instrument;

wherein said superabsorbent polymer is present in an amount sufficient to prevent leakage of a writing medium from a desired portion of said writing instrument to an undesired portion within said writing instrument or to the outside of said writing instrument; and said superabsorbent polymer substantially irreversibly absorbs said writing medium under ambient conditions.

2. A writing instrument according to claim 1, wherein said superabsorbent polymer is selected from the group consisting of: starch; a cellulosic polymer; poly(acrylamide); poly(alkacrylamide); poly(acrylate); poly(alkyl acrylate); poly(alkyl alkacrylate); poly(hydroxy-functionalized alkacrylate); poly(acrylic acid); at least partially neutralized poly(acrylic acid); at least partially saponified poly(acrylic acid); poly(alkacrylic acid); at least partially neutralized poly(alkacrylic acid); at least partially saponified poly(alkacrylic acid); poly(vinyl alcohol); poly(acrylonitrile); poly(alkacrylonitrile); poly(vinyl acetate); poly(alkylene oxide), poly(ethylene oxide); a polymer containing maleic anhydride repeat units; a copolymer containing at least one of the aforementioned components or a repeat unit thereof; and a mixture or blend thereof.

3. A writing instrument according to claim 1, wherein said component of said writing instrument comprises at least one of said writing medium reservoir, said writing tip, a temporary ink storage area, an end plug, a point support, or a front nose cone.

4. A writing instrument according to claim 3, wherein said temporary ink storage area is disposed between said writing tip and said writing medium reservoir and comprises a baffle configured to store abnormally high writing medium flow resulting from increased air pressure in said writing medium reservoir, said baffle comprising:

an axial bore through which an ink transfer member extends;

a plurality of spaced apart annular elements or fins with annular spaces formed therebetween for temporary storage of said writing medium;

a narrow slit running longitudinally through said fins that defines an ink groove for communicating said writing medium from said writing medium reservoir, via said ink transfer member, to said annular spaces and also for communicating said annular spaces with one another; and a groove, wider than said ink groove, formed longitudinally through said fins, that defines an air groove for communicating air from an air vent hole in said baffle to said writing medium reservoir as said writing medium is expended;

wherein said superabsorbent polymer is provided at a location along said baffle not interfering with flow of said writing medium from said writing medium reservoir to said writing tip during normal writing use.

5. A writing instrument according to claim 1, further comprising a temporary ink storage having an interior surface area;

wherein said superabsorbent polymer is provided as one or more of the following:

a coating on at least a portion of the interior surface of said temporary ink storage area;

a pre-fabricated, shaped component disposed in contact with, or immediately adjacent to, and optionally adhered to, at least one component of said writing instrument;

a material from which at least one component of said writing instrument is formed; or a mass of packed particles, packed powder, packed granules, or gelatinous superabsorbent material disposed in contact with, or immediately adjacent to, and optionally adhered to, the interior surface of the boundaries of said temporary ink storage area, or portions thereof; and wherein said superabsorbent polymer does not substantially interfere with the desired communication or flow of said writing medium from said writing medium reservoir to said writing tip during normal writing instrument use.

6. A writing instrument according to claim 1, further comprising:

a writing instrument cap having an interior surface and an exterior surface and being removably disposed over at least said writing tip of said writing instrument, said interior surface covering said writing tip when said writing instrument is not in use;

wherein said superabsorbent polymer is associated with said interior surface of said writing instrument cap in an amount sufficient to prevent abnormal or undesired leakage of said writing medium from said interior surface of said writing instrument cap.

7. A writing instrument according to claim 1, wherein no more than about 10% of said writing medium that becomes absorbed by said superabsorbent polymer can be released without external application of temperature and/or pressure.

8. A writing instrument according to claim 1, wherein said superabsorbent polymer has an absorption capacity of at least about 100 grams of water per gram of polymer and/or an absorption capacity of at least about 20 grams of writing medium per gram of polymer.

9. A writing instrument according to claim 1, wherein the ratio of the maximum amount of said writing medium contained within said writing instrument to the total amount of said superabsorbent polymer in said writing instrument is at least about 5:1.

10. A writing instrument according to claim 1, which is hand-held and/or finger-manipulable.

11. A writing instrument comprising:

a writing medium reservoir having an interior portion;

a writing tip; and a superabsorbent polymer associated with a component of said writing instrument;

wherein:

said superabsorbent polymer is present in an amount sufficient to prevent leakage of said writing medium from a desired portion of said writing instrument to an undesired portion within said writing instrument or to the outside of said writing instrument;

said superabsorbent polymer does not substantially interfere with the desired communication or flow of said writing medium from said writing medium reservoir to said writing tip during normal writing instrument use; and said superabsorbent polymer is provided as one or more of the following:

a coating on at least a portion of one component of said writing instrument; or a mass of packed particles, packed powder, packed granules, or gelatinous superabsorbent material disposed in contact with, or immediately adjacent to, and optionally adhered to, a interior surface of the boundaries of at least a portion of one component of said writing instrument.

12. A writing instrument comprising:

a writing medium reservoir;

a writing tip;

a writing instrument cap having an interior surface and an exterior surface and being removably disposed over at least said writing tip of said writing instrument, said interior surface covering said writing tip when said writing instrument is not in use; and a superabsorbent polymer;

wherein said superabsorbent polymer is associated with said interior surface of said writing instrument cap in an amount sufficient to prevent abnormal or undesired leakage of said writing medium from said interior surface of said writing instrument cap.

13. A writing instrument comprising:

a writing medium reservoir;

a writing tip; and a superabsorbent polymer associated with a component of said writing instrument;

wherein said superabsorbent polymer is present in an amount sufficient to prevent leakage of a writing medium from a desired portion of said writing instrument to an undesired portion within said writing instrument; and the ratio of the maximum amount of said writing medium contained within said writing instrument to the total amount of said superabsorbent polymer in said writing instrument is at least about 5:1.

14. The writing instrument of claim 13, wherein the ratio of the maximum amount of said writing medium contained within said writing instrument to the total amount of said superabsorbent polymer in said writing instrument is at least about 10:1.

15. The writing instrument of claim 14, wherein the ratio of the maximum amount of said writing medium contained within said writing instrument to the total amount of said superabsorbent polymer in said writing instrument is at least about 20:1.

16. A writing instrument comprising:

a writing medium reservoir;

a writing tip;

a superabsorbent polymer associated with a component of said writing instrument; and a temporary ink storage area disposed between said writing tip and said writing medium reservoir comprising a baffle configured to store abnormally high writing medium flow resulting from increased air pressure in said writing medium reservoir;

wherein:

said superabsorbent polymer is present in an amount sufficient to prevent leakage of said writing medium from a desired portion of said writing instrument to an undesired portion within said writing instrument or to the outside of said writing instrument;

said superabsorbent polymer is provided at a location along said baffle not interfering with flow of said writing medium from said writing medium reservoir to said writing tip during normal writing use; and said baffle comprises:

a plurality of spaced apart annular elements or fins with annular spaces formed therebetween for temporary storage of said writing medium;

a narrow slit running longitudinally through said fins that defines an ink groove for communicating said writing medium from said writing medium reservoir, via said ink transfer member, to said annular spaces and also for communicating said annular spaces with one another; and a groove, wider than said ink groove, formed longitudinally through said fins, that defines an air groove for communicating air from an air vent hole in said baffle to said writing medium reservoir as said writing medium is expended.

* * * * *